US007498912B2

(12) United States Patent
Tsutsui et al.

(10) Patent No.: US 7,498,912 B2
(45) Date of Patent: Mar. 3, 2009

(54) ELECTROMAGNETIC RELAY

(75) Inventors: Kazuhiro Tsutsui, Iida (JP); Hideyuki Wachi, Iida (JP)

(73) Assignee: OMRON Corporation, Kyoto (JP)

( * ) Notice: Subject to any disclaimer, the term of this patent is extended or adjusted under 35 U.S.C. 154(b) by 309 days.

(21) Appl. No.: 11/330,751

(22) Filed: Jan. 12, 2006

(65) Prior Publication Data

US 2006/0152310 A1 Jul. 13, 2006

(30) Foreign Application Priority Data

Jan. 13, 2005 (JP) ..... 2005-006614

(51) Int. Cl.
*H01H 67/02* (2006.01)

(52) U.S. Cl. ..... 335/128; 335/78

(58) Field of Classification Search ..... 335/78–86, 335/128, 129–131, 202
See application file for complete search history.

(56) References Cited

U.S. PATENT DOCUMENTS

| | | | | |
|---|---|---|---|---|
| 4,959,627 | A * | 9/1990 | Iizumi et al. | 335/106 |
| 5,382,934 | A * | 1/1995 | Hendel et al. | 335/159 |
| 5,612,658 | A * | 3/1997 | Hendel et al. | 335/78 |
| 5,889,454 | A * | 3/1999 | Hendel | 335/177 |
| 6,573,814 | B1 * | 6/2003 | Ichikawa et al. | 335/128 |
| 7,135,946 | B2 * | 11/2006 | Hoffmann | 335/78 |

FOREIGN PATENT DOCUMENTS

| | | | |
|---|---|---|---|
| DE | 3843359 | A1 | 7/1989 |
| EP | 1065689 | A2 | 1/2001 |
| EP | 1284493 | A | 2/2003 |
| JP | 03201338 | A | 9/1991 |

OTHER PUBLICATIONS

European Search Report dated Aug. 27, 2007 issued in Application No. 06100247.3-1231, 4 pages.
Patent Abstracts of Japan, Publication No. 03201338 dated Sep. 3, 1991, 1 page.

* cited by examiner

*Primary Examiner*—Elvin G Enad
*Assistant Examiner*—Bernard Rojas
(74) *Attorney, Agent, or Firm*—Osha • Liang LLP

(57) ABSTRACT

It is intended to provide an electromagnetic relay which resolves problems of large base size and difference in spring constant. In a facing gap defined between a pair of electromagnet units disposed on a base in parallel to each other and with shaft lines being oriented to an identical direction, a pair of moving contact springs overlaid along a vertical direction on the base and an A-fixed terminal unit and a B-fixed terminal unit provided with a plurality of contacts to which contacts of the moving contact springs selectively contact depending on excitation/non-excitation states of the electromagnetic units are housed. At least one of component parts of the respective electromagnetic units are included in electromagnetic connection passages between the moving contact springs and C-terminals.

1 Claim, 13 Drawing Sheets

PRIOR ART

PRIOR ART

ELECTROMAGNETIC RELAY

BACKGROUND OF THE INVENTION

1. Field of the Invention

The present invention relates to an electromagnetic relay and, particularly, to an electromagnetic relay for forward reverse control, such as a motor and a solenoid.

2. Description of the Related Art

FIG. 12 is a block diagram showing a forward reverse control circuit. A forward reverse control circuit 1 is provided with two electromagnetic relays 2 and 3. An A-terminal 2*a* of one of the electromagnetic relays 2 and 3 (hereinafter referred to as first electromagnetic relay 2) is connected to a plus electric source (hereinafter referred to as +E); a B-terminal 2*b* of the first electromagnetic relay 2 is connected to a ground potential (hereinafter referred to as GND); and a C-terminal 2*c* of the first electromagnetic relay 2 is connected to one of terminals (terminal 4*a*) of a load 4 such as a motor and solenoid. An A-terminal 3*a* of the other electromagnetic relay 3 (hereinafter referred to as second electromagnetic relay 3) is connected to the +E; a B-terminal 3*b* of the second electromagnetic relay 3 is connected to the GND; and a C-terminal 3*c* of the first electromagnetic relay 2 is connected to the other terminal 4*b* of the load 4. As used herein, the alphabet A added to each of the terminals means that the terminal is connected to an A-contact (normal open contact); the alphabet B means that the terminal is connected to a B-contact (normal close contact); and the alphabet C means that the terminal is connected to a C-contact (COM contact).

In such forward reverse control circuit 1, since the terminal 4*a* of the load 4 is connected to the GND via a contact 2*e* of the first electromagnetic relay 2 and the terminal 4*b* is connected to the GND via a contact 3*e* of the second electromagnetic relay 3 in a normal state (when the first and the second electromagnetic relays 2 and 3 are in a non-excitation state), the load 4 does not operate in the normal state.

When a control voltage is applied to a coil terminal 2*d* of the first electromagnetic relay 2, a coil 2*f* of the first electromagnetic relay 2 is excited to change the position of the contact 2*e*, so that the terminal 4*a* of the load 4 is connected to the +E via the contact 2*e* of the first electromagnetic relay 2. In such state, the second electromagnetic relay 3 is turned off, and the terminal 4*b* of the load 4 is connected to the GND via the contact 3*e* of the second electromagnetic relay 3, so that a current flows to the load 4 in a direction (see an arrow A) of "+E→contact 2*e* of first electromagnetic relay 2→terminal 4*a* of load 4→terminal 4*b* of load 4→contact 3*e* of second electromagnetic relay 3→GND".

When a control voltage is applied to a coil terminal 3*d* of the second electromagnetic relay 3, a coil 3*f* of the second electromagnetic relay 3 is excited to change the position of the contact 3*e*, so that the terminal 4*b* of the load 4 is connected to the +E via the contact 3*e* of the second electromagnetic relay 3. In such state, the first electromagnetic relay 2 is turned off, and the terminal 4*a* of the load 4 is connected to the GND via the contact 2*e* of the first electromagnetic relay 2, so that a current flows to the load 4 in a reverse direction (see an arrow B) of "+E→contact 3*e* of second electromagnetic relay 3→terminal 4*b* of load 4→terminal 4*a* of load 4→contact 2*e* of first electromagnetic relay 2→GND".

As described above, since it is possible to change the direction of driving current applied to the load 4 such as a motor and a solenoid by the use of the forward reverse control circuit 1 of FIG. 12, it is possible to change a rotation direction of the motor or a driving direction of the solenoid.

By the way, since the forward reverse control circuit 1 of FIG. 12 requires two electromagnetic relays, the forward reverse control circuit 1 undesirably needs extra effort and a relatively large mounting space when it is integrated into an appliance.

FIG. 13 is a conceptual diagram showing a conventional technology which resolves the above drawbacks (see, for example, Patent Literature 1). Referring to FIG. 13, an electromagnetic relay 5 is provided with a rectangular base 6 having a length La, and a pair of electromagnets 7 and 8 disposed parallelly to each other on the base 6, armatures 9 and 10 disposed on the electromagnets 7 and 8, a pair of insulators 11 and 12 disposed on side faces of the armatures 9 and 10, a pair of moving contact springs 13 and 14 sandwiched between the insulators 11 and 12, and a pair of fixed contact terminal plates 15 and 16 disposed at swinging ends of the moving contact springs 13 and 14 and can be handled as one unit.

Each of the pair of moving contact springs 13 and 14 is an L-shaped flat plate spring, and the moving contact spring 13 is disposed on the moving contact spring 14. Therefore, when the base 6 is viewed from above, the moving contact spring 14 cannot be seen since it is hidden under the moving contact spring 13.

A terminal 13*a* for connecting a load 17 is formed on a fixed end of the moving contact spring 13, and a terminal 14*a* for connecting a load 17 is formed on a fixed end of the moving contact spring 14. Moving contacts 13*b* and 13*c* are attached to opposite sides of the swinging end of the moving contact spring 13, and moving contacts 14*b* and 14*c* are attached to opposite sides of the swinging end of the moving contact spring 14.

The fixed contact terminal plate 15 is provided with a fixed terminal 15*a* for connecting to the +E and the GND, and the fixed contact terminal plate 16 is provided with a fixed terminal 16*a* for connecting to the +E and the GND. Fixed contacts 15*b*, 15*c*, 16*b*, and 16*c* are attached to the fixed contact terminal plates 15 and 16 at predetermined positions. The fixed contacts 15*b*, 15*c*, 16*b*, and 16*c* contact the moving contacts 13*b*, 13*c*, 14*b*, and 14*c* in predetermined combinations when the electromagnets 7 and 8 are excited.

The predetermined combinations are (1) the moving contact 13*b* and the fixed contact 15*b*, (2) the moving contact 13*c* and the fixed contact 16*c*, (3) the moving contact 14*b* and the fixed contact 16*b*, and (4) the moving contact 14*c* and the fixed contact 15*c*.

With such constitution, when the electromagnets 7 and 8 are not excited, the combinations of (2) the moving contact 13*c* and the fixed contact 16*c* and (3) the moving contact 14*b* and the fixed contact 16*b* are employed so that the GND is supplied to both ends of the load 17. When the electromagnet 7 on the left hand side in FIG. 13 is excited in this state, the armature 9 is operated so that the insulator 11 attached to the armature 9 moves to the right. Accordingly, the moving contact spring 13 is pressed by the insulator 11 to move to the right, thereby achieving the combination (1) the moving contact 13*b* and the fixed contact 15*b*, so that a current flows in the order of the +E, the terminal 15*a*, the fixed contact 15*b*, the moving contact 13*b*, the moving contact spring 13, the terminal 13*a*, the load 17, the terminal 14*a*, the moving contact spring 14, the moving contact 14*b*, the fixed contact 16*b*, the terminal 16*a*, and the GND.

When the electromagnet 8 on the right hand side in FIG. 13 is excited, the armature 10 is operated so that the insulator 12 attached to the armature 10 moves to the left. Accordingly, the moving contact spring 14 is pressed by the insulator 12 to move to the left, thereby achieving the combination (4) the moving contact 14*c* and the fixed contact 15*c*, so that a current flows in the reverse order of the +E, the terminal 15*a*, the fixed contact 15*c*, the moving contact 14*c*, the moving contact spring 14, the terminal 14*a*, the load 17, the terminal 13*a*, the moving contact spring 13, the moving contact 13*c*, the fixed contact 16*c*, the terminal 16*a*, and the GND.

[Patent Literature 1] Japanese Patent No. 2890581

SUMMARY OF THE INVENTION

The above-described conventional technology has the following drawbacks.

(1) Large Base Size

The length La of the base 6 is at least a total of a shaft length Lb of the electromagnets 7 and 8, a length Lc required for the movements of the armatures 9 and 10, and a length Ld required for mounting the two fixed contact terminal plates 15 and 16. In view of a mounting space in an appliance, it is desired that the lengths Lb, Lc, and Ld should be small as possible. Since the lengths Lb and Lc depend on the size of the electromagnets 7 and 8, an electromagnet appropriate for downsizing (electromagnet having a smaller Lb and Lc) is naturally used. Accordingly, a last object left for downsizing is the length Ld.

In order to downsize the length Ld, a thickness of the fixed contact terminal plates 15 and 16 and a gap between the fixed contact terminal plates 15 and 16 may be reduced, and the fixed contact terminal plates 15 and 16 may be disposed as close as possible to the electromagnets 7 and 8.

However, there are limits for the downsizing of the thickness and the gap of the fixed contact terminal plates 15 and 16 because the size of the fixed contact terminal plates 15 and 16 should no be smaller than the sizes of the contacts 15*c*, 15*b*, 16*c*, and 16*b*. Also, in order not to disturb the electrical insulation and the movements of the moving contact springs 13 and 14, the distance to the electromagnets 7 and 8 cannot be reduced by a large scale. Accordingly, since it is impossible to eliminate the length Ld in the constitution of the conventional technology, the conventional technology has the drawback of the long length (La) of the base 6 due to the length Ld.

(2) Difference in Spring Constant

A length of the moving contact spring 14 disposed under the moving contact spring 13 is shorter than a length of the moving contact spring 13. The difference in length is set in order to avoid disturbances between the moving contact springs 13 and 14 because each of the moving contact springs 13 and 14 is formed from a flat and L-shaped plate, and that the terminals 13*a* and 14*a* are formed on the ends of the L-shaped flat plates.

When lengths of a pair of plate springs formed from an identical spring material are varied, one of the springs becomes soft, and the other spring becomes hard, i.e., spring constants are varied. The same is applicable to the moving contact springs 13 and 14 of the conventional technology. Such difference in spring constant requires an independent designing of coils (the coils of the electromagnets 7 and 8) for driving the moving contact springs 13 and 14. That is, it is necessary to vary a resistance value depending on the coils in order to generate an appropriate attraction force in accordance with the spring constants or to design component parts independently for the coils. However, with such designing, designing of the appliance into which the electromagnetic relay 5 is to be integrated will be complicated due to the difference in coil resistance and the troublesome designing of different component parts.

In view of the above-described circumstance, an object of this invention is to provide an electromagnetic relay which resolves the problems of the large size base and the difference in spring constant.

An aspect of the invention is an electromagnetic relay comprising: housing, in a predetermined facing gap defined between a first electromagnet unit and a second electromagnetic unit disposed parallelly to each other on a base in such a fashion that axial directions thereof are oriented to an identical direction, a first moving contact spring and a second moving contact spring disposed in such a fashion as to be overlaid along a vertical direction on the base and an A-fixed terminal unit and a B-fixed terminal unit provided with a plurality of contacts with which contacts of the first and the second moving contact springs selectively contact depending on a state of excitation/non-excitation of the first and the second electromagnet units; and disposing at least one of component parts of the first electromagnet unit and the second electromagnet unit on an electric connection passage between the first and the second moving contact springs and a pair of C-terminals.

As used herein, the A-fixed terminal unit means a fixed terminal unit having an A-contact, i.e. a normal open contact. Likewise, the B-fixed terminal unit means a fixed terminal unit having a B-contact, i.e. a normal close contact.

Also, the overlaying along the vertical direction on the base means that, when a platform of the base is a horizontal plane, one of the first moving contact spring and the second moving contact spring is disposed above the other one along a line or plane making a right angle with the horizontal plane (the upper moving contact spring is detached from the horizontal plane, and the lower moving contact spring is disposed closer to the horizontal plane).

Also, the at least one of component parts may be the yoke of each of the first electromagnet unit and the second electromagnet unit.

In this invention, the moving contact springs, the A-terminal unit, and the B-terminal unit are housed in the facing gap of the electromagnet units, and the moving contact springs are electrically connected to the C-terminals via the component parts of the electromagnet units.

Another aspect of the invention is an electromagnetic relay comprising: a) disposing a first electromagnet unit and a second electromagnet unit on a rectangular base made from an insulating material in such a fashion that one side of the first electromagnet unit is parallel to one side of the second electromagnet unit with a predetermined facing gap being defined therebetween and mounting an A-fixed terminal unit and a B-fixed terminal unit in the facing gap; b) attaching a first moving contact spring and a first return spring to a first iron piece disposed adjacent to a magnetic pole of the first electromagnet unit and fixing a tip of the first return spring to a first yoke disposed along the side of the first electromagnet unit; c) attaching a second moving contact spring and a second return spring to a second iron piece disposed adjacent to a magnetic pole of the second electromagnet unit and fixing a tip of the second return spring to a second yoke disposed along the side of the second electromagnet unit; d) overlaying the first moving contact spring and the second moving contact spring along a vertical direction on the base; and e) contacting a contact of the first moving contact spring and a contact of the second moving contact spring to a contact of the B-fixed terminal unit when both of the first electromagnet unit and the second electromagnet unit are not excited, contacting the contact of the first moving contact spring to the A-fixed terminal unit when the first electromagnet unit is excited, and contacting the contact of the second moving contact to the A-fixed terminal unit when the second electromagnet unit is excited.

With this invention, thanks to the item a), it is possible to keep a length of one of four sides of the base, which is parallel to a shaft of the electromagnet units, to be substantially equal to a length of the electromagnet units without influences of presence of the A-fixed terminal unit and the B-fixed terminal unit. Therefore, it is possible to downsize the base, thereby realizing an electromagnetic relay of a small mounting area.

Also, thanks to the item b), it is possible to retain the first iron piece at an initial position by a spring force of the first return spring when the first electromagnet unit is not excited, while it is possible to cause the first iron piece to approach to the magnetic pole of the first electromagnet unit against the spring force of the first return spring when the first electromagnet unit is excited.

Also, thanks to the item c), it is possible to retain the second iron piece at an initial position by a spring force of the second return spring when the second electromagnet unit is not excited, while it is possible to cause the second iron piece to approach to the magnetic pole of the second electromagnet unit against the spring force of the second return spring when the second electromagnet unit is excited.

Also, thanks to the item d), it is possible to avoid mutual disturbances of the first and the second moving contact springs, so that the first and the second iron pieces return to the initial positions and the first and the second moving contact springs approach in a swinging manner to the magnetic poles without any disturbance.

Also, thanks to the item e), it is possible to switch the contacts of the first and the second moving contact springs independently between the B-contact (normal close contact) and the A-contact (normal open contact) depending on the combinations of excitation and non-excitation of the first and the second electromagnet units, thereby making it possible to perform a forward reverse control of a motor or a solenoid, for example.

Still another aspect of the invention is the electromagnetic relay according to the aspect of the invention, wherein the first iron piece, the first return spring, and the first yoke are included in an electrical connection passage between one of a pair of C-terminals and the contact of the first moving contact spring, and the second iron piece, the second return spring, and the second yoke are included in an electrical connection passage between the other one of the C-terminals and the contact of the second moving contact spring.

With this invention, the C-terminals are electrically connected to the first and the second moving contact springs via the first and the second yoke and the first and the second return springs. Accordingly, it is unnecessary to connect the C-terminals to the first and the second moving contact springs by using a dedicated wiring or the like. Therefore, since troubles otherwise caused by disconnection do not occur, a production cost is reduced, and reliability is improved.

According to the invention, since the moving contact springs, the A-fixed terminal unit, and the B-fixed terminal unit are housed in the facing gap between the electromagnet units, it is possible to keep a length of one of four sides of the base, which is parallel to a shaft of the electromagnet units, to be substantially equal to a length of the electromagnet units without influences of presence of the A-fixed terminal unit and the B-fixed terminal unit. Therefore, it is possible to downsize the base, thereby realizing an electromagnetic relay of a small mounting area.

Also, since the moving contact springs are electrically connected to the C-terminals via the component parts of the electromagnet units, it is unnecessary to form the C-terminals integrally with the moving contact springs as in the conventional technology (see the terminals 13*a* and 14*a* of FIG. 13). Accordingly, it is unnecessary to consider disturbances otherwise caused by mounting the terminals on the base, and, therefore, it is possible to use moving contact springs having an identical shape and to even out the spring constants of the moving contact springs.

DESCRIPTION OF THE PREFERRED EMBODIMENT

Hereinafter, one embodiment of this invention will be described based on the drawings. Identifications and examples of details as well as exemplifications of values, letters, and other symbols in the following description are not more than references used for clarifying idea of this invention, and it is apparent that the idea of this invention is not limited by whole or part of the references. Also, explanations for known methods, known processes, known architectures, known circuit constitutions, and the like (hereinafter referred to as known particulars) are avoided in the following description, and such avoidance is for the purpose of simplifying the description and is not for the purpose of excluding whole or part of the known particulars. Since the known particulars had been familiar to those skilled in the art at the time of filing of this patent application, the known particulars are naturally included in the following description.

Figure 1:
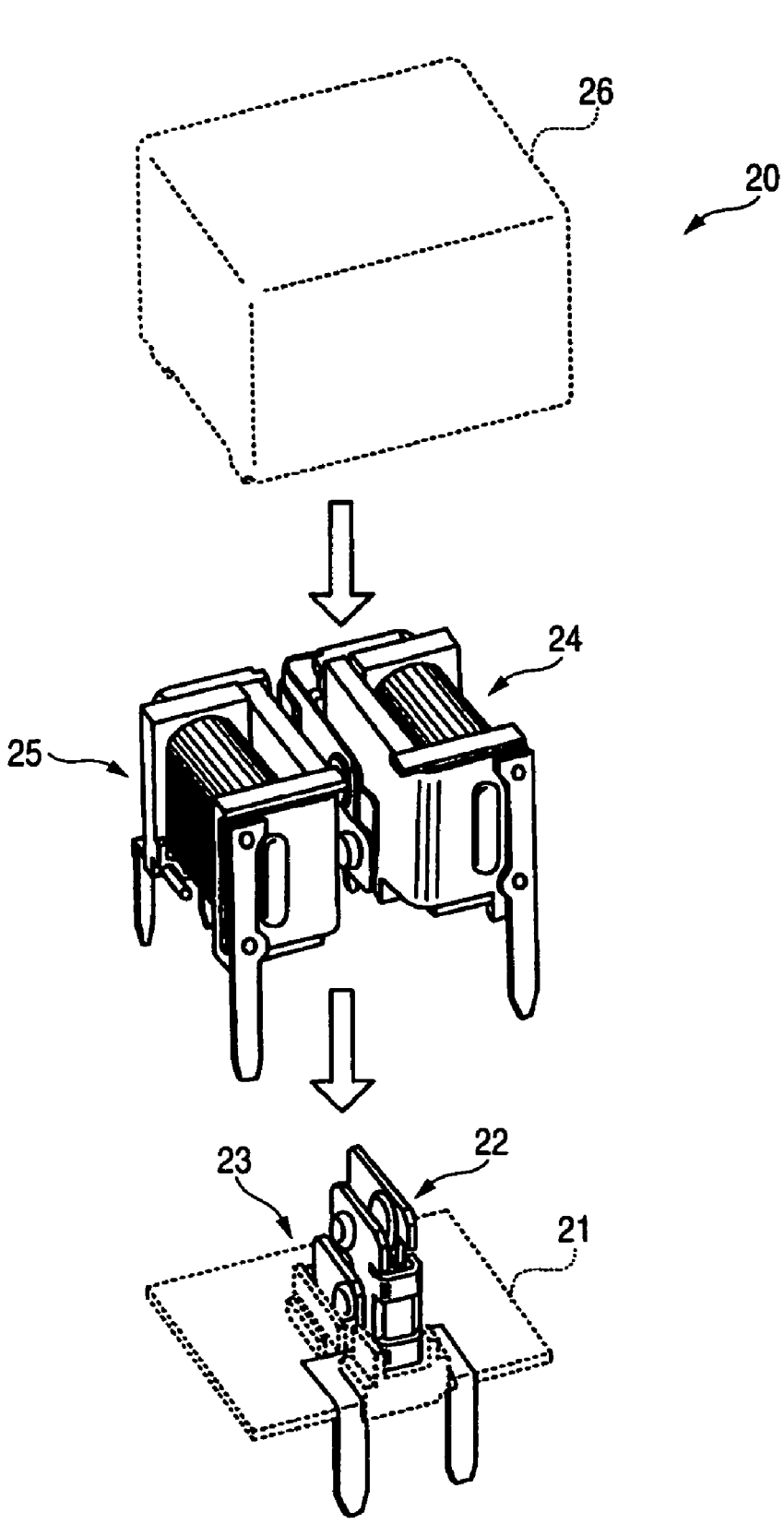
FIG. 1 is a diagram showing assembly of an electromagnetic relay 20 according to one embodiment.

FIG. 1 is a diagram showing assembly of an electromagnetic relay 20 according to the embodiment. In the electromagnetic relay 20, an A-fixed terminal unit 22 and a B-fixed terminal unit 23, a first electromagnet unit 24, and a second electromagnet unit 25 are mounted on a base 21 having a substantially square shape and made from an insulating material such as plastic, and a dust prevention case 26 is used for covering the electromagnetic relay 20 when so required. The alphabet A of the A-fixed terminal unit means normal open, and the alphabet B of the B-fixed terminal unit means normal close.

Figure 2A:
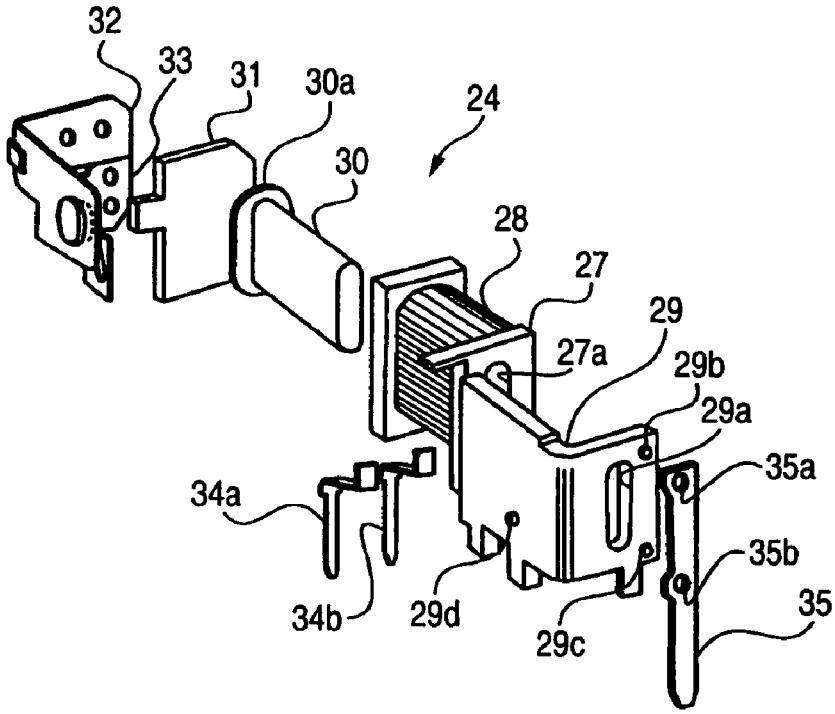
FIG. 2 is an exploded view showing a first electromagnet unit 24 and a second electromagnet unit 25.
Figure 2B:
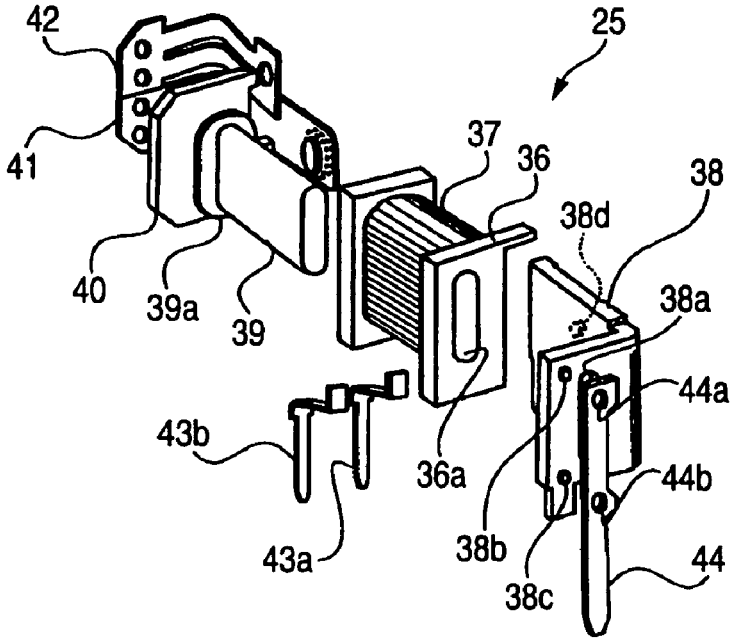

FIG. 2 is an exploded view showing the first electromagnet unit 24 and the second electromagnet unit 25. The first electromagnet unit 24 is provided with a bobbin 27 made from an insulating material, a coil 28 wound around the bobbin 27, a yoke (hereinafter referred to as first yoke 29) made from a conducting material, the first yoke 29 being disposed along one end face and one side of the bobbin 27 and bent at an angle of about 90 degrees, an iron core 30 to be inserted into a shaft hole 27*a* of the bobbin 27 and a through-hole 29*a* formed on the first yoke 29, and an iron piece (hereinafter referred to as first iron piece 31) disposed adjacent to a magnetic pole 30*a* of the iron core 30. The first electromagnet unit 24 is further provided with a moving contact spring (hereinafter referred to as first moving contact spring 32) to be caulked to one side (the side not shown in FIG. 2) of the first iron piece 31, a return spring (hereinafter referred to as first return spring 33), a pair of coil terminals 34*a* and 34*b* electrically connected to opposite ends of a winding wire of the coil 28, and a C-terminal 35 attached to the first yoke 29 by caulking projections 29*b* and 29*c* of the first yoke 29 to engagement holes 35*a* and 35*b* and electrically connected to the first return spring 33 and the first moving contact spring 32 via the first yoke 29.

The second electromagnet unit 25 is provided with a bobbin 36 made from an insulating material, a coil 37 wound around the bobbin 36, a yoke (hereinafter referred to as second yoke 38) made from a conducting material, the second yoke 38 being disposed along one end face and one side of the bobbin 36 and bent at an angle of about 90 degrees, an iron core 39 to be inserted into a shaft hole 36*a* of the bobbin 36 and a through-hole 38*a* formed on the second yoke 38, and an iron piece (hereinafter referred to as second iron piece 40) disposed adjacent to a magnetic pole 39*a* of the iron core 39. The second electromagnet unit 25 is further provided with a moving contact spring (hereinafter referred to as second moving contact spring 41) to be caulked to one side (the side not shown in FIG. 2) of the second iron piece 40, a return spring (hereinafter referred to as second return spring 42), a pair of coil terminals 43*a* and 43*b* electrically connected to opposite ends of a winding wire of the coil 37, and a C-terminal 44 attached to the second yoke 38 by caulking projections 38*b* and 38*c* of the second yoke 38 to engagement holes 44*a* and 44*b* and electrically connected to the second return spring 42 and the second moving contact spring 41 via the second yoke 38.

Figure 3A:
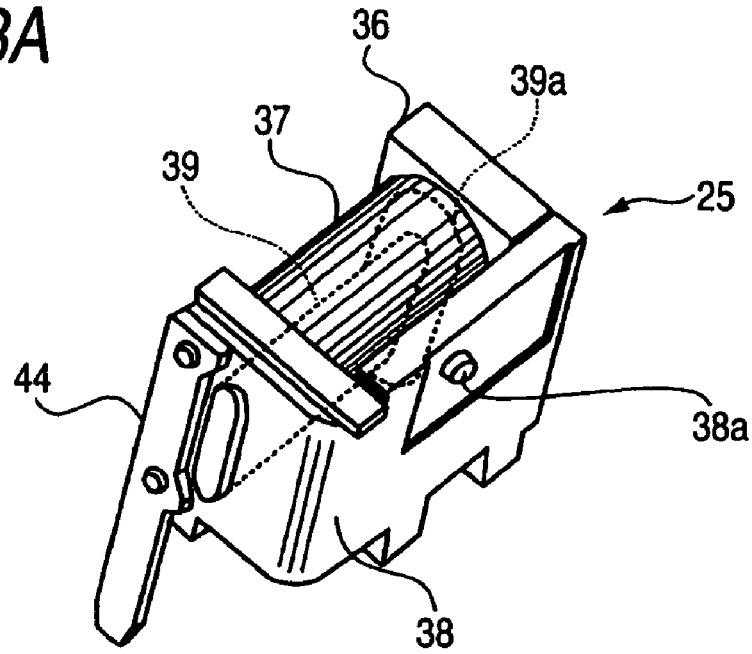
FIG. 3 is a diagram showing an appearance of the second electromagnet unit 25 before attaching a second iron piece 40, a second moving contact spring 41, and a second return spring 42 to the second electromagnet unit 25.
Figure 3B:
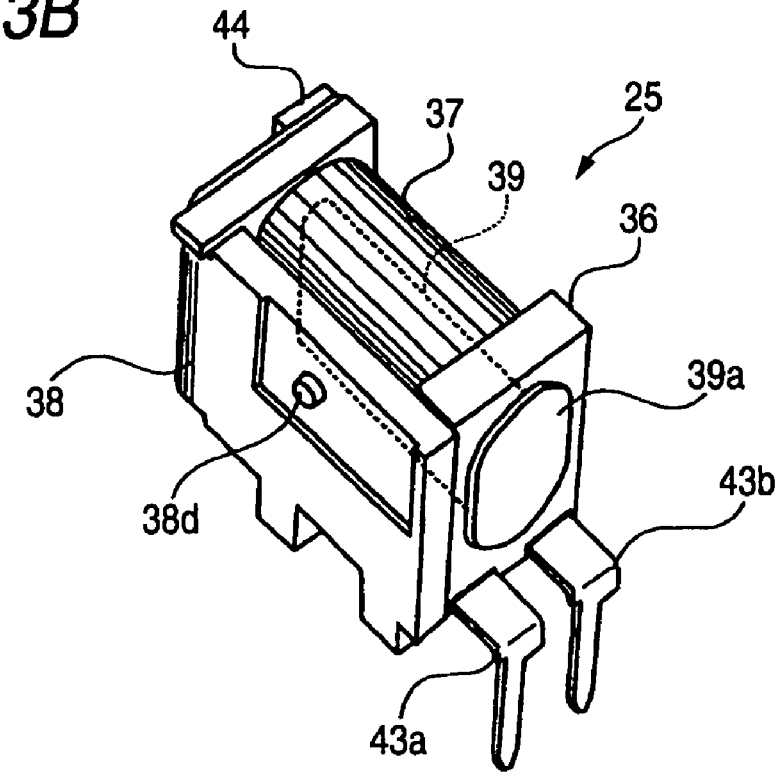

FIG. 3 is a diagram showing an appearance of the second electromagnet unit 25 before attaching the second iron piece 40, the second moving contact spring 41, and the second return spring 42 to the second electromagnet unit 25. As shown in FIG. 3, the second electromagnet unit 25 is assembled by inserting the iron core 39 into a shaft center of the bobbin 36 on which the coil 37 and the coil terminals 43*a* and 43*b* are mounted and disposing the second yoke 38 along one end and one side of the bobbin 36 (preferably, the second yoke 38 is engaged to the bobbin 36). The magnetic pole 39*a* of the iron core 39 is exposed to the other end face (surface on which the second yoke 38 is not disposed) of the bobbin 36, and the second iron piece 40 (not shown) is disposed adjacent to the magnetic pole 39*a*. A tip of the second return spring 42 attached to the second iron piece 40 is caulked to a projection 38*d* formed on the second yoke 38.

Though not shown, an assembled state of the first electromagnet unit 24 before attaching the iron piece 31, the first moving contact spring 32, and the first return spring 33 is the same as that of the second electromagnet unit 25. It can be said that the assembled state of the first electromagnet unit 24 is different from that of the second electromagnet unit 25 since the assembled state of the first electromagnet unit 24 is the same as a mirror projection image of the assembled state of the second electromagnet unit 25. That is, the first electromagnet unit 24 in the assembled state and the second electromagnet unit 25 in the assembled state are different from each other only from the viewpoint that they are in a mirror projection relationship when shaft lines of the iron cores 30 and 39 are aligned parallel to each other.

Figure 4A:
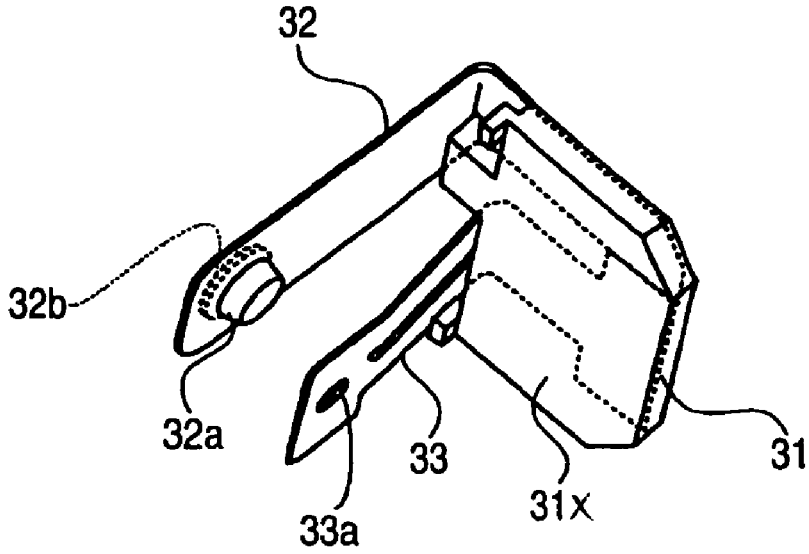
FIG. 4 is a diagram showing an assembled state of a first iron piece 31, a first moving contact spring 32, and a first return spring 33 and an assembled state of the second iron piece 40, the second moving contact spring 41, and the second return spring 42.
Figure 4B:
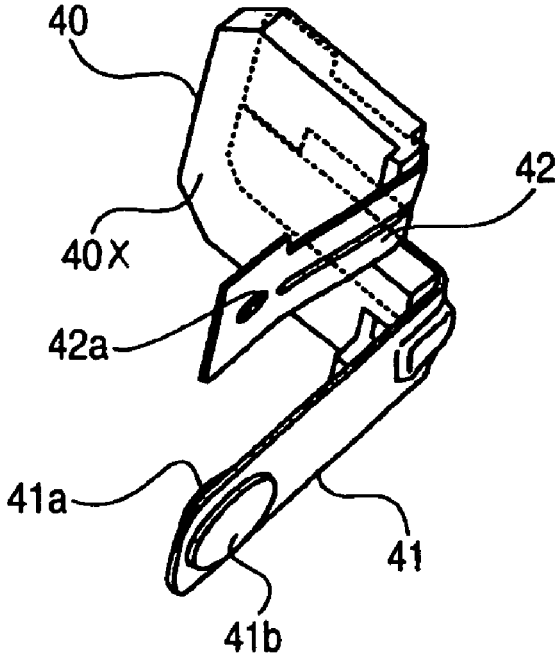

Shown in FIG. 4 are a diagram (a) of an assembled state of the first iron piece 31, the first moving contact spring 32, and the first return spring 33 and a diagram (b) of an assembled state of the second iron piece 40, the second moving contact spring 41, and the second return spring 42.

The first moving contact spring 32 which is bent to form a substantially L-shape and the first return spring 33 are caulked to a reverse side (side not shown in FIG. 4) of an electromagnetism attraction surface 31*x* of the first iron piece 31. Also, the second moving contact spring 41 which is bent to form a substantially L-shape and the second return spring 42 are caulked to a reverse side (side not shown in FIG. 4) of an electromagnetism attraction surface 40*x* of the second iron piece 40.

A contact 32*a* is attached to one side of the first moving contact spring 32 in the vicinity of a tip of the first moving contact spring 32, and a contact 32*b* is attached to the other side of the first moving contact spring 32 in the vicinity of the tip of the first moving contact spring 32. A hole 33*a* to be used for the caulking to the first yoke 29 is formed on the first return spring 33 in the vicinity of a tip of the first return spring 33. In the same manner, contacts 41*a* and 41*b* are attached to opposite sides of the second moving contact spring 41 in the vicinity of a tip of the second moving contact spring 41, and a hole 42*a* for caulking to the first yoke 29 is formed on the second return spring 42 in the vicinity of a tip of the second return spring 42.

In FIG. 4(*a*), the first moving contact spring 32 and the first return spring 33 are positioned on the left hand side, and the first moving contact spring 32 is positioned above the second return spring 33. In turn, in FIG. 4(*b*), the second moving contact spring 41 and the second return spring 42 are positioned on the right hand side, and the second moving contact spring 41 is positioned below the second return spring 42. Such illustration is for the purpose of clarifying that the two assembled bodies have an identical shape. More specifically, the shape of the assembled body of FIG. 4(*a*) is identical to the assembled body of FIG. 4(*b*) when the assembled body of FIG. 4(*a*) is rotated by 180 degrees in clockwise direction, and the shape of the assembled body of FIG. 4(*b*) is identical to the assembled body of FIG. 4(*a*) when the assembled body of FIG. 4(*b*) is rotated by 180 degrees in anticlockwise direction.

Figure 5A:
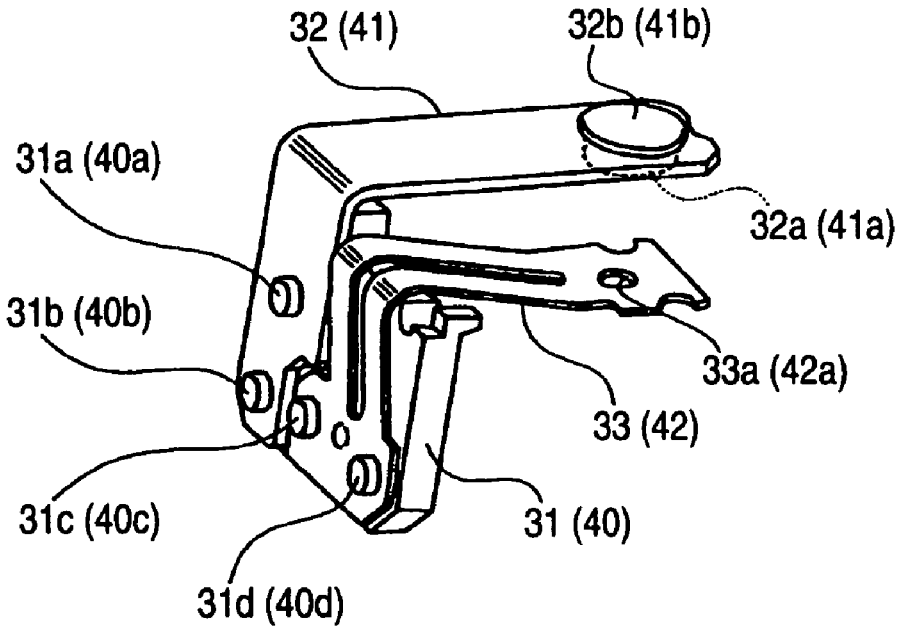
FIG. 5 is a diagram showing the assembled body of FIG. 4 as viewed from the rear.
Figure 5B:
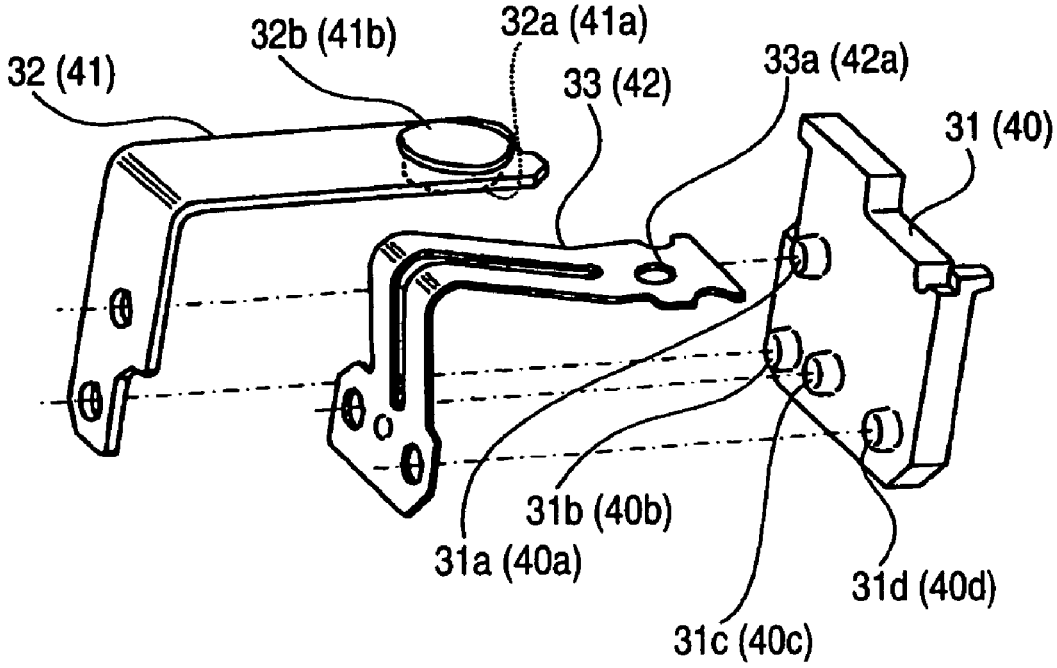

FIG. 5 is a diagram showing the assembled body of FIG. 4(*a*) as viewed from the rear. Since the two assembled bodies have the identical shape as described above, the diagram is equivalent to that of the assembled body of FIG. 4(*b*) as viewed from the rear. In FIG. 5, the first moving contact spring 32 (the second moving contact spring 41) is caulked to rear face projections 31*a* (40*a*) and 31*b* (40*b*) of the first iron piece 31 (the second iron piece 40), and the first return spring 33 (the second return spring 42) is caulked to rear face projections 31*c* (40*c*) and 31*d* (40*d*) of the first iron piece 31 (the second iron piece 40). The first iron piece 31 and the second iron piece have an identical shape. The first moving contact spring 32 and the second moving contact spring 41 have an identical shape. The first return spring 33 and the second return spring 42 have an identical shape.

Figure 6:
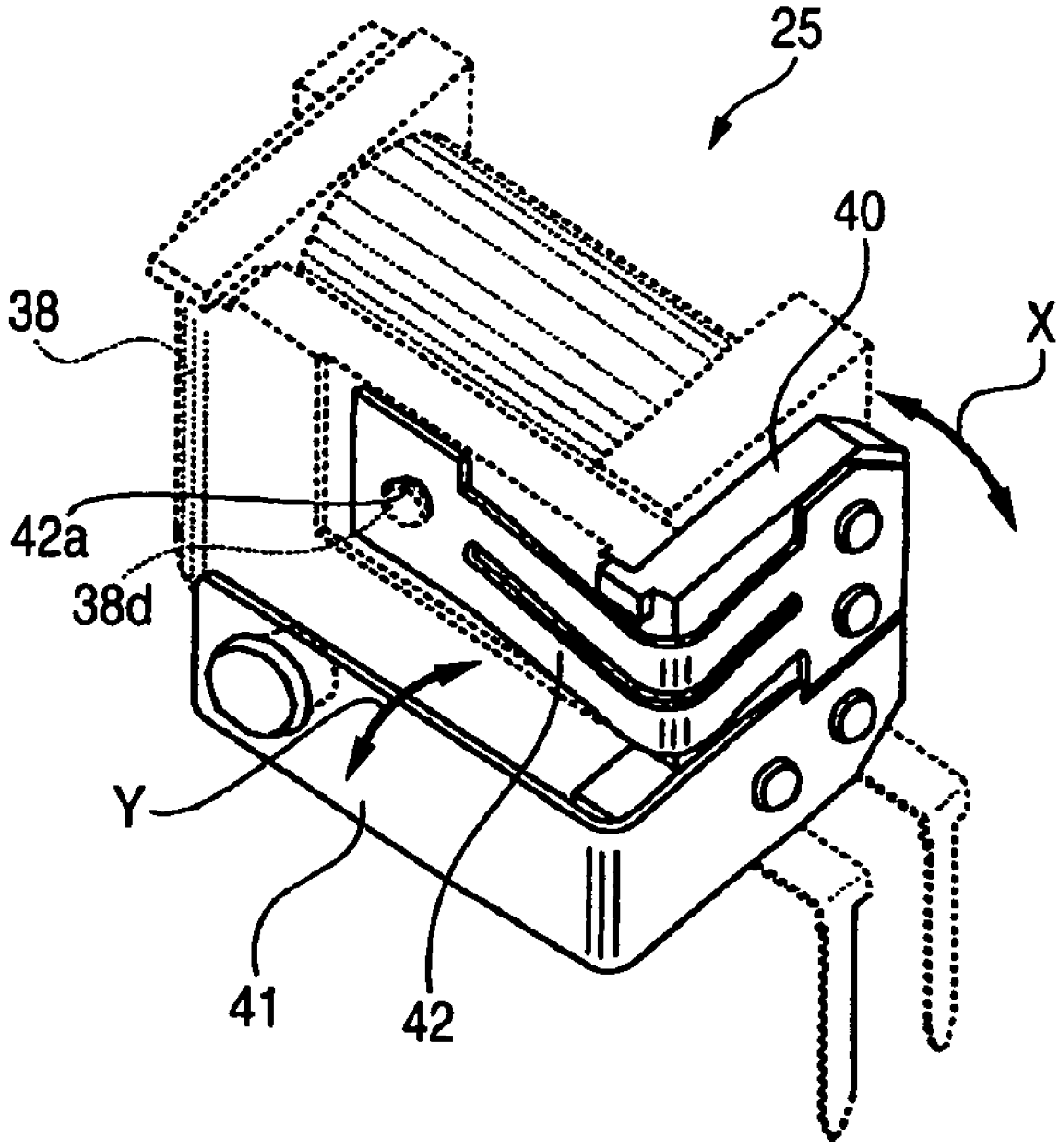
FIG. 6 is a diagram showing an appearance of the second electromagnet unit 25 after attaching the second iron piece 40, the second moving contact spring 41, and the second return spring 42 to the second electromagnet unit 25.

FIG. 6 is a diagram showing an assembled state of the second electromagnet unit 25 after attaching the second iron piece 40, the second moving contact spring 41, and the second return spring 42 to the second electromagnet unit 25. As shown in FIG. 6, the projection 38*d* of the second yoke 38 is inserted into a hole 42*a* of the second return spring 42, and a head of the projection 38*d* is flattened for the caulking.

As described in the foregoing, the second iron piece 40 is disposed adjacent to the magnetic pole 39*a* of the iron core 39 (see FIG. 3) and is detached from the magnetic pole 39*a* by a small gap due to a spring force of the first return spring 33. When a magnetic force is generated in the magnetic pole 39*a*, the second iron piece 40 is attracted to the magnetic pole 39*a* despite the spring force. That is, the second iron piece 40 moves in directions indicated by a two-headed arrow X from the position (position of the projection 38*d*) at which the second return spring 42 is attached to the second yoke 38 depending on absence or presence of the magnetic force of the magnetic pole 39*a*. Thus, the second moving contact spring 41 attached to the second iron piece 40 follows the movements of the second iron piece 40 to move in directions indicated by a two-headed arrow Y of approaching to and departing from the side of the second yoke 38.

Though not shown, the movement of the first electromagnet unit 24 after attaching the first iron piece 31, the first moving contact spring 32, and the first return spring 33 is the same as that of the second electromagnet unit 25. That is, the first iron piece 31 of the first electromagnet unit 24 moves in directions from the position at which the first return spring 33 is attached to the first yoke 29 depending on absence or presence of the magnetic force of the magnetic pole 30*a*. Thus, the first moving contact spring 32 attached to the first iron piece 31 follows the movements of the first iron piece 31 to move in directions of approaching to and departing from the side of the first yoke 29.

Figure 7A:
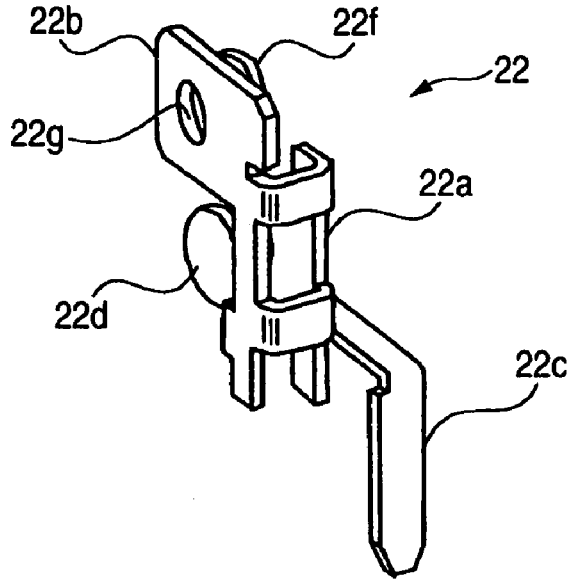
FIG. 7 is a block diagram showing an A-fixed terminal unit 22.
Figure 7B:
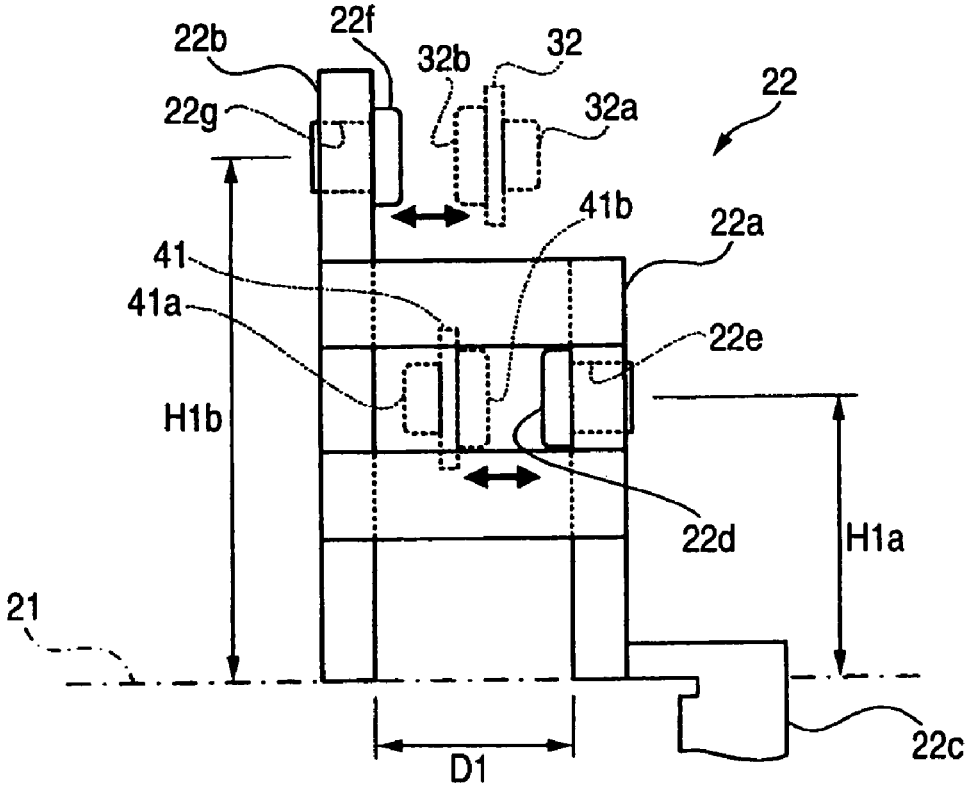

FIG. 7 is a block diagram showing the A-fixed terminal unit 22. The A-fixed terminal unit 22 is formed by punching out a metal plate and then so bending the metal plate as to form a shape shown in the drawing. More specifically, the A-fixed terminal unit 22 has walls 22*a* and 22*b* opposed to each other with a predetermined gap D1 being defined therebetween, a terminal 22*c* extending from a lower end of the wall 22*a*, a mounting hole 22*e* for a contact 22*d* fitted to the wall 22*a* at a position of a height H1*a* from the lower end of the wall 22*a*, and a mounting hole 22*g* for a contact 22*f* fitted to the wall 22*b* at a position of a height H1*b* from a lower end of the wall 22*b*. The contacts 22*d* and 22*f* are normal open contacts (A contacts).

The height H1*a* is equal to a height from the base 21 to the center of the contacts 41*a* and 41*b* of the second moving contact spring 41 when the second electromagnet unit 25 is attached to the base 21. The height H1*b* is equal to a height from the base 21 to the center of the contacts 32*a* and 32*b* of the first moving contact spring 32 when the first electromagnet unit 24 is attached to the base 21. The gap D1 between the walls 22*a* and 22*b* is set in accordance with a degree of the movement (see two-headed arrow Y of FIG. 6) of the contacts 32*a*, 32*b*, 41*a*, and 41*b* of the first and the second moving contact springs 32 and 42.

Figure 8A:
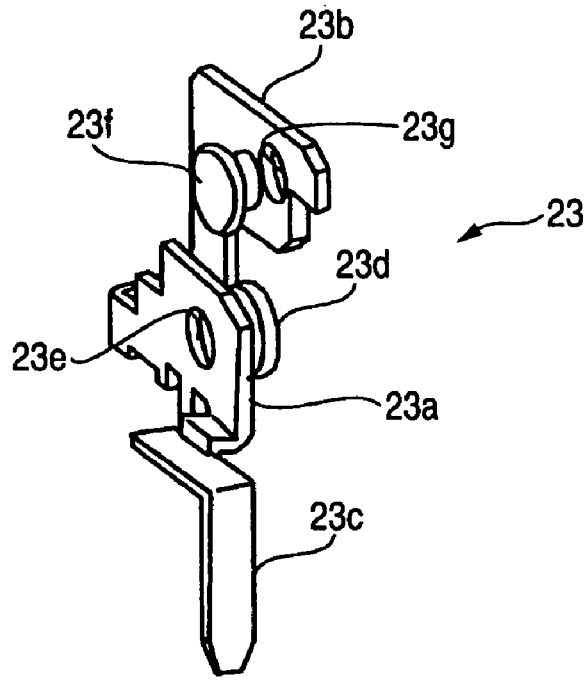
FIG. 8 is a block diagram showing a B-fixed terminal unit 23.
Figure 8B:
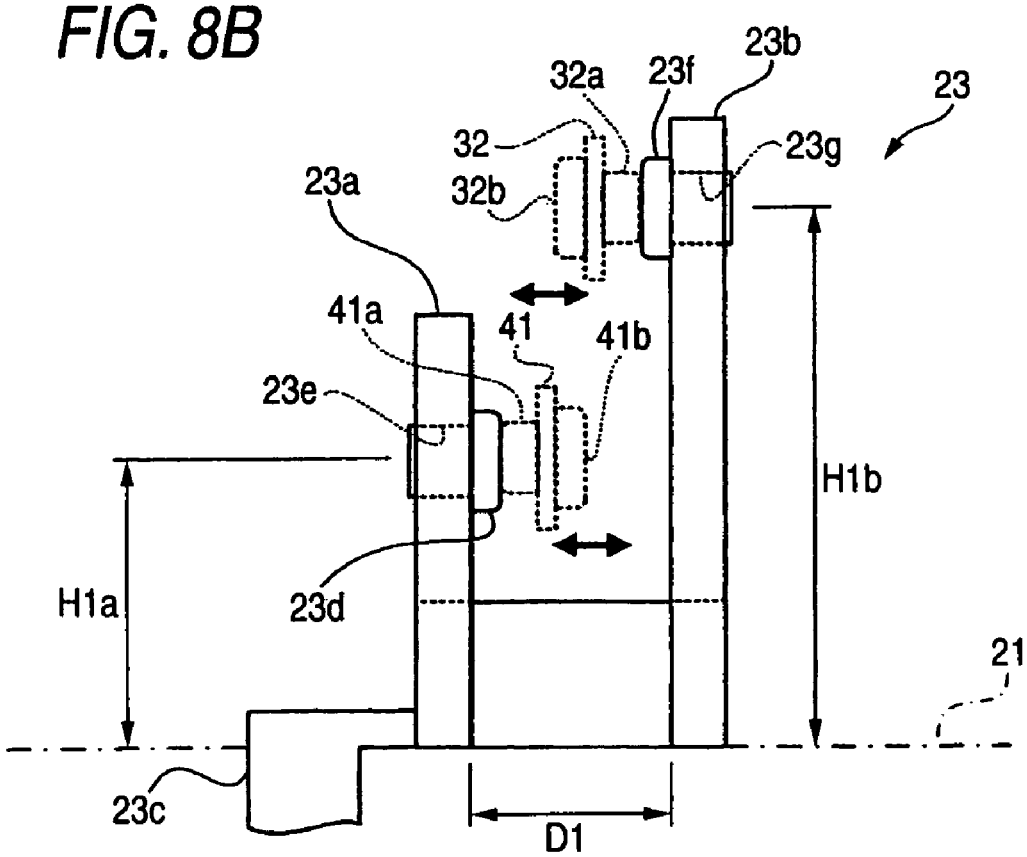

FIG. 8 is a block diagram showing the B-fixed terminal unit 23. Like the A-fixed terminal unit 22, the B-fixed terminal unit 23 is formed by punching out a metal plate and then so bending the metal plate as to form a shape shown in the drawing. The B-fixed terminal unit 23 has walls 23*a* and 23*b* opposed to each other with a predetermined gap D1 being defined therebetween, a terminal 23*c* extending from a lower end of the wall 22*a*, a mounting hole 23*e* for a contact 23*d* fitted to the wall 23*a* at a position of a height H1*a* from the lower end of the wall 23*a*, and a mounting hole 23*g* for a contact 23*f* fitted to the wall 23*b* at a position of a height H1*b* from a lower end of the wall 23*b*. The contacts 23*d* and 23*f* are normal close contacts (B contacts). The heights H1*a* and H1*b* and the gap D1 are set in the same manner as in the A-fixed terminal unit 22.

Each of the A-fixed terminal unit 22 and the B-fixed terminal unit 23 having the above-described constitutions is mounted on the base 21 at a predetermined position. When the A-fixed terminal unit 22 and the B-fixed terminal unit 23 are mounted on the base 21, the terminals 32*a* and 32*b* of the first moving contact spring 32 are disposed in the gap (gap D1) between the walls 22*a* and 22*b* of the A-fixed terminal unit 22, and the terminals 41*a* and 41*b* of the second moving contact spring 41 are disposed in the gap (gap D1) between the walls 23*a* and 23*b* of the B-fixed terminal unit 23.

When both of the first electromagnet unit 24 and the second electromagnet unit 25 are not excited, the right contact 32*a* of the first moving contact spring 32 contacts the contact 23*f* of the wall 23*b* of the B-fixed terminal unit 23, while the left contact 41*a* of the second moving contact spring 41 contacts the contact 23*d* of the wall 23*a* of the B-fixed terminal unit 23 (normal close state of FIG. 8(*b*)).

When the first electromagnet unit 24 is excited, the first moving contact spring 32 moves to the left in the drawing so that the left contact 32*b* of the first moving contact spring 32 contacts the contact 22*f* of the wall 22*b* of the A-fixed terminal unit 22 (see FIG. 7(*b*)).

When the second electromagnet unit 25 is excited, the second moving contact spring 41 moves to the right in the drawing so that the right contact 41*b* of the second moving contact spring 41 contacts the contact 22*d* of the wall 22*a* of the A-fixed terminal unit 22 (see FIG. 7(*b*)).

Figure 9:
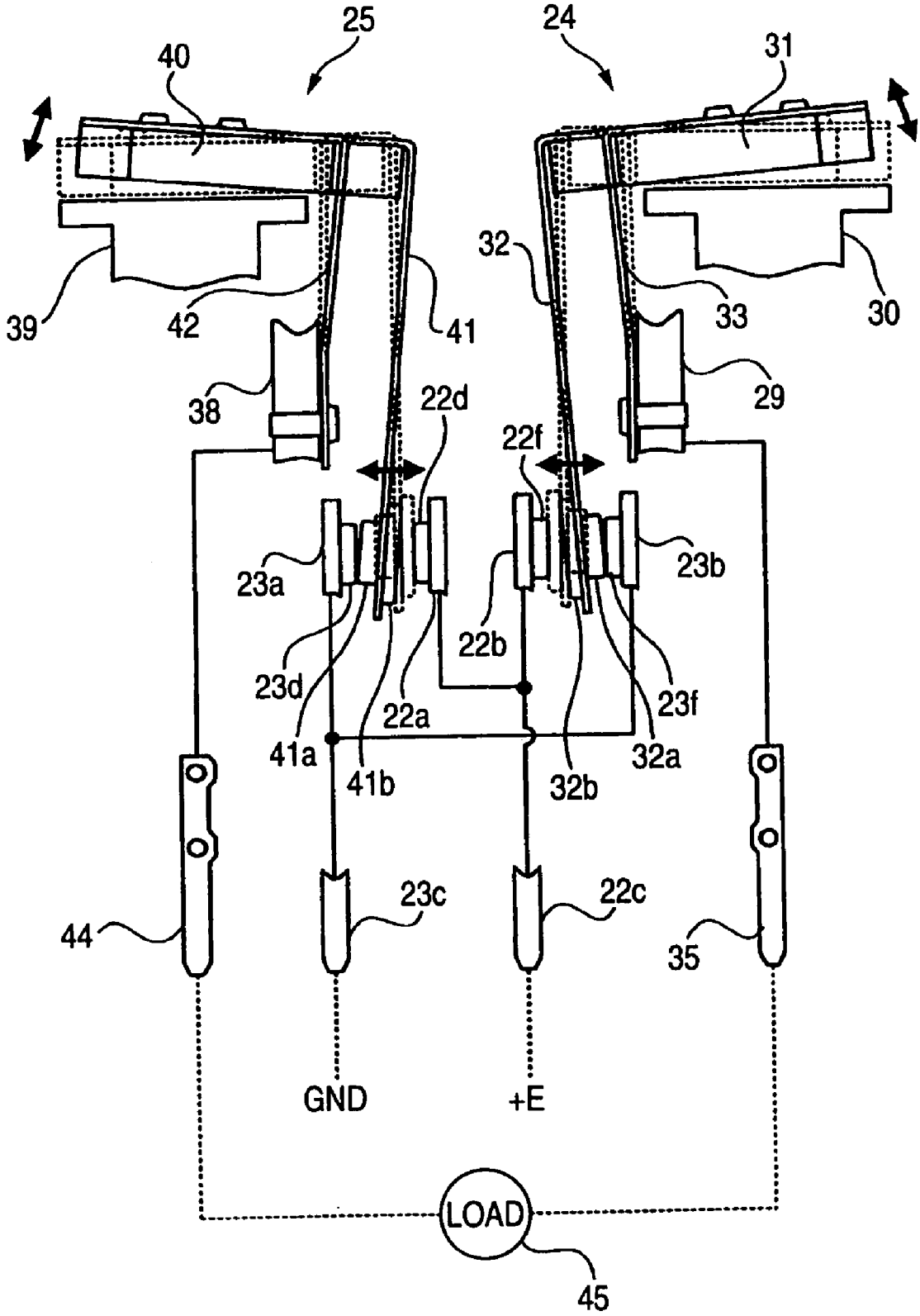
FIG. 9 is a conceptual diagram of a contact operation of the electromagnetic relay 20.

FIG. 9 is a conceptual diagram showing a contact operation of the electromagnetic relay 20. In FIG. 9, a thick line indicates positions of the first and the second iron pieces 31 and 40, the first and the second moving contact springs 32 and 41, and the first and the second return springs 33 and 42 when the first and the second electromagnet units 24 and 25 are not excited, and a broken line indicates the positions when the first and the second electromagnet units 24 and 25 are excited.

When the first and the second electromagnet units 24 and 25 are not excited, both ends of the load 45 are connected to the GND via the C-terminals 35 and 44, the contacts 32*a* and 41*a* of the first and the second moving contact springs 32 and 41, and the contacts 23*d* and 23*f* of the B-fixed terminal unit 23. Accordingly, the load 45 does not operate.

When the first electromagnet unit 24 is excited, a passage of the +E, the terminal 22*c*, the wall 22*b*, the contact 22*f*, the contact 32*b*, the first moving contact spring 32, the first return spring 33, the first yoke 29, the C-terminal 35, the load 45, the C-terminal 44, the second yoke 38, the second return spring 42, the second moving contact spring 41, the contact 41*a*, the contact 23*d*, the terminal 23*c*, and the GND is formed.

When the second electromagnet unit 25 is excited, a passage of the +E, the terminal 22*c*, the wall 22*a*, the contact 22*d*, the contact 41*b*, the second moving contact spring 41, the second return spring 42, the second yoke 38, the C-terminal 44, the load 45, the C-terminal 35, the first yoke 29, the first return spring 33, the first moving contact spring 32, the contact 32*a*, the contact 23*f*, the terminal 23*c*, and the GND is formed.

The above two passages in the excited states are reverse to each other. Therefore, it is possible to control the load 45 in a forward reverse manner.

By the way, the conceptual diagram of FIG. 9 is used only for the purpose of explaining the forward reverse control operation, and constitutional characteristics of this embodiment are not precisely illustrated. Though the first and the second moving contact springs 32 and 41 and the contacts 22*d*, 22*f*, 23*d*, and 23*f* of the A-fixed terminal unit 22 and the B-fixed terminal unit 23 are aligned horizontally parallel to one another in the conceptual diagram, such alignment is shown for the brevity of illustration and is different from an actual alignment. The actual constitution is such that the second moving contact spring 41 is disposed under the first moving contact spring 32; the contact 23*d* of the B-fixed terminal unit 23 is disposed under the contact 22*f* of the A-fixed terminal unit 22; and the contact 22*d* of the A-fixed terminal unit 22 is disposed under the contact 23*f* of the B-fixed contact unit 23 (see FIG. 11).

Figure 10:
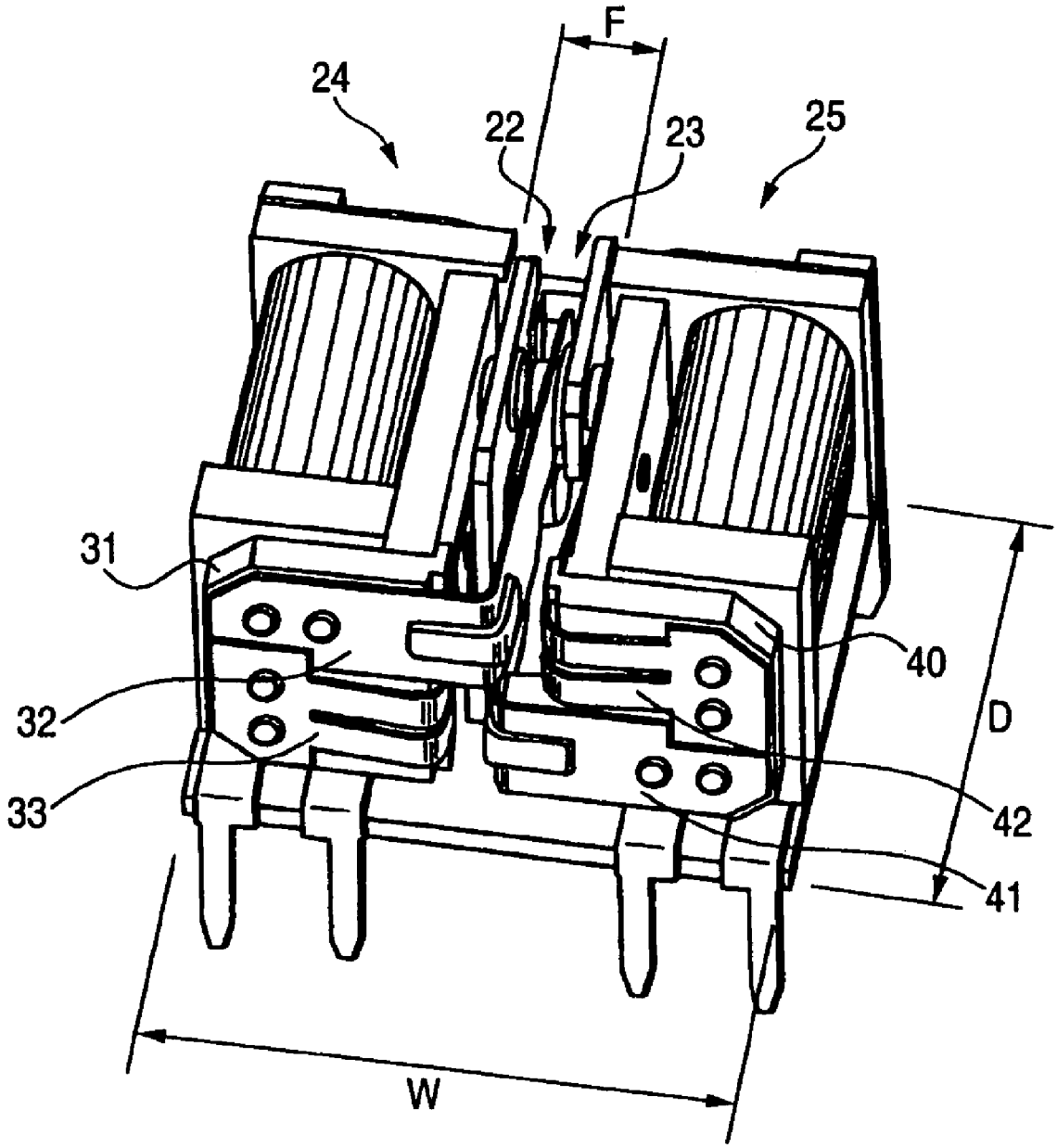
FIG. 10 is a diagram showing a completion of the electromagnetic relay 20 of the embodiment.

FIG. 10 is a diagram showing a completion of the electromagnetic relay 20 of this embodiment. Note that the dust protection case 26 is omitted for the brevity of illustration. In the electromagnetic relay 20, the first electromagnet unit 24, the second electromagnet unit 25, the A-fixed terminal unit 22, and the B-fixed terminal unit 23 are mounted on the base 21 having a square or square-like rectangular shape of the size of W×D. The electromagnet units (the first electromagnet unit 24 and the second electromagnet unit 25) are disposed in such a fashion that the shaft lines (lines connecting the poles) are parallel to each other, and a facing gap F is defined therebetween. The facing gap F is the space for housing the first and the second moving contact springs 32 and 41, the first and the second return springs 33 and 42, the A-fixed terminal unit 22, and the B-fixed terminal unit 23.

Figure 11:
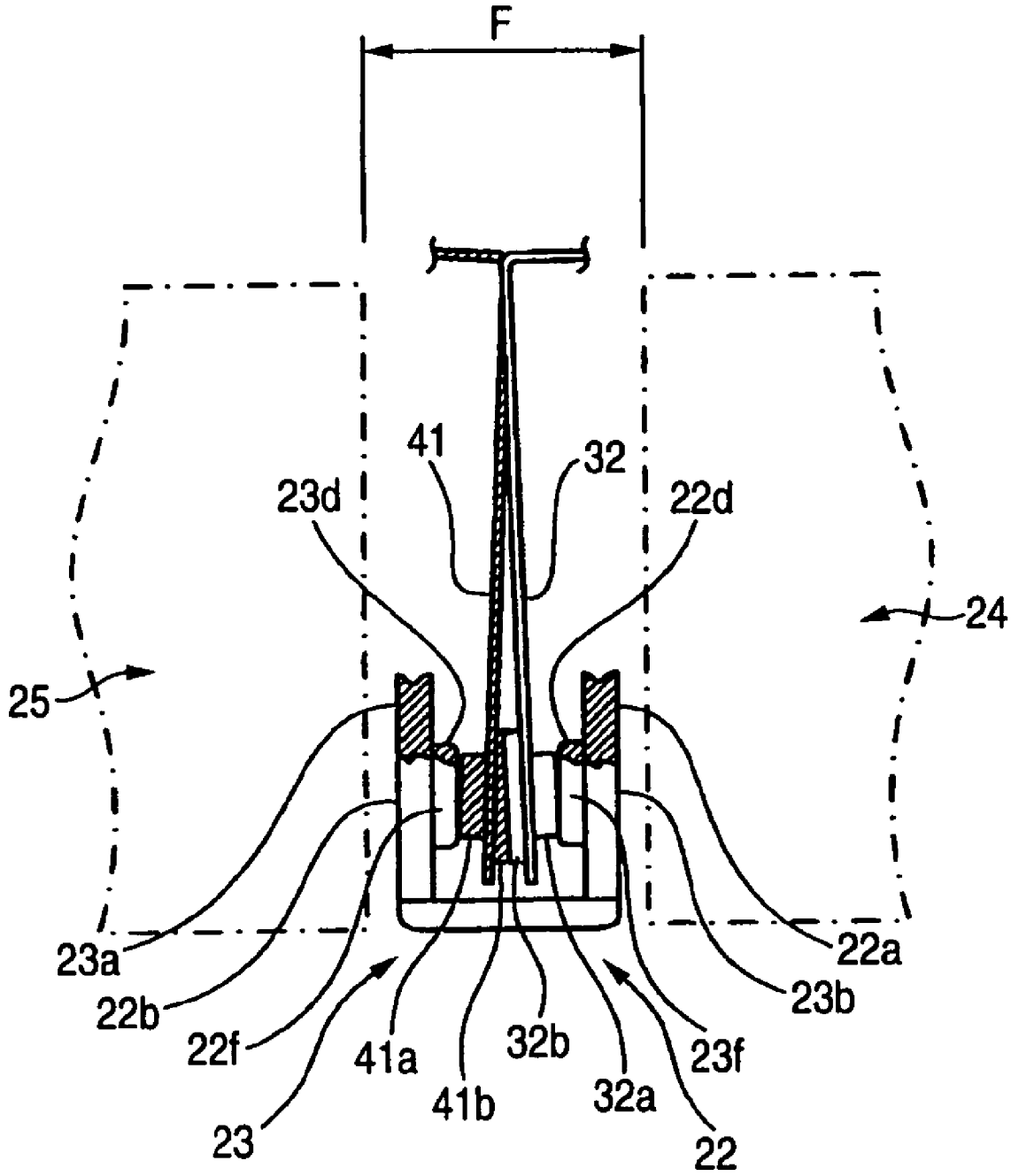
FIG. 11 is a conceptual diagram showing a facing gap F in an actual housing.
Figure 12:
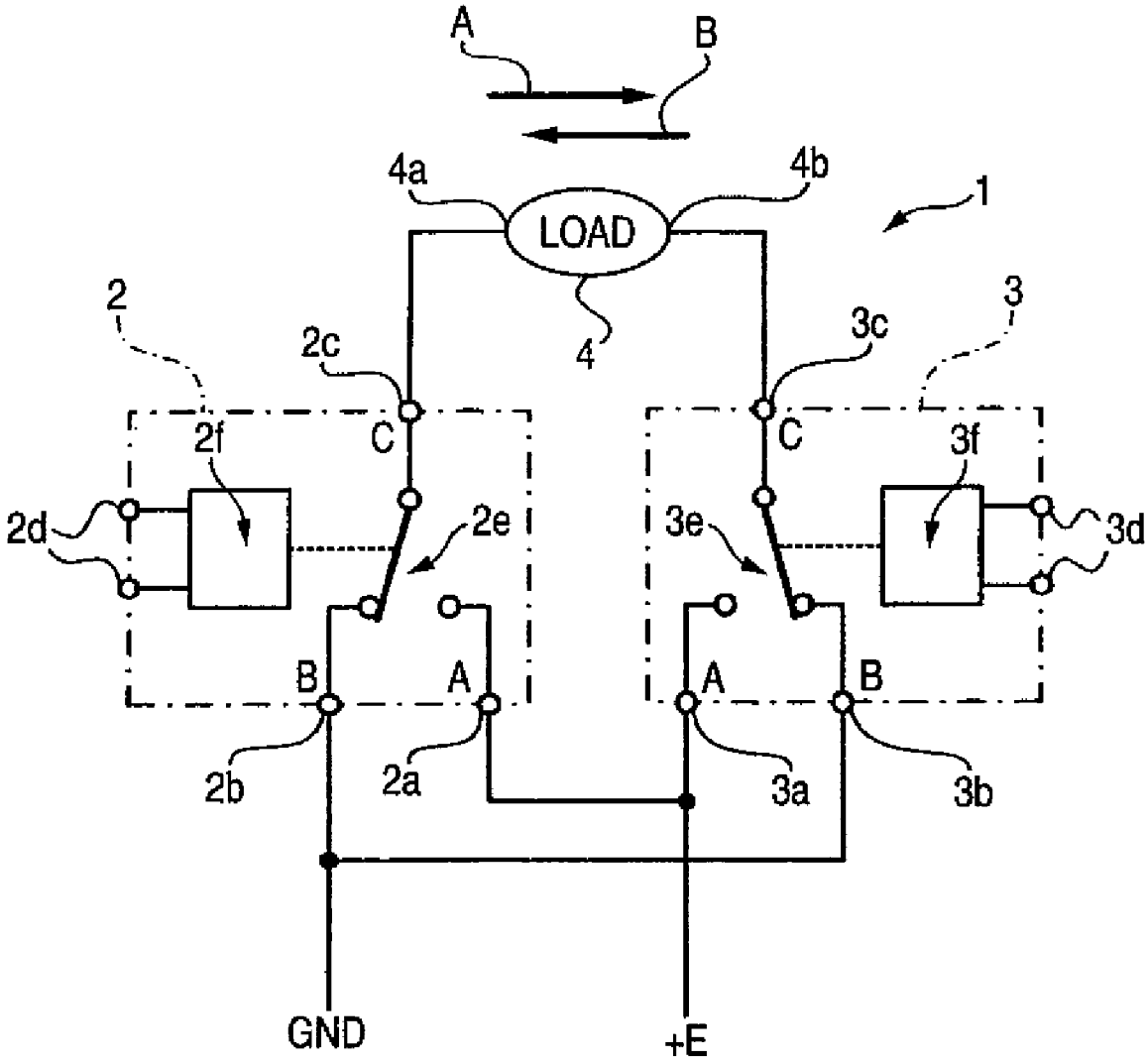
FIG. 12 is a block diagram showing a forward reverse control circuit such as a motor and a solenoid.
Figure 13A:
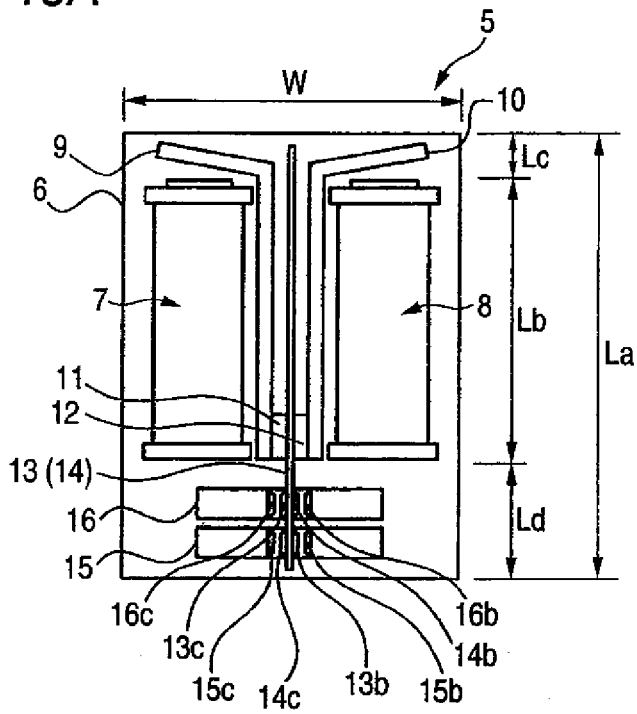
FIG. 13 is a conceptual diagram showing a conventional technology.
Figure 13B:
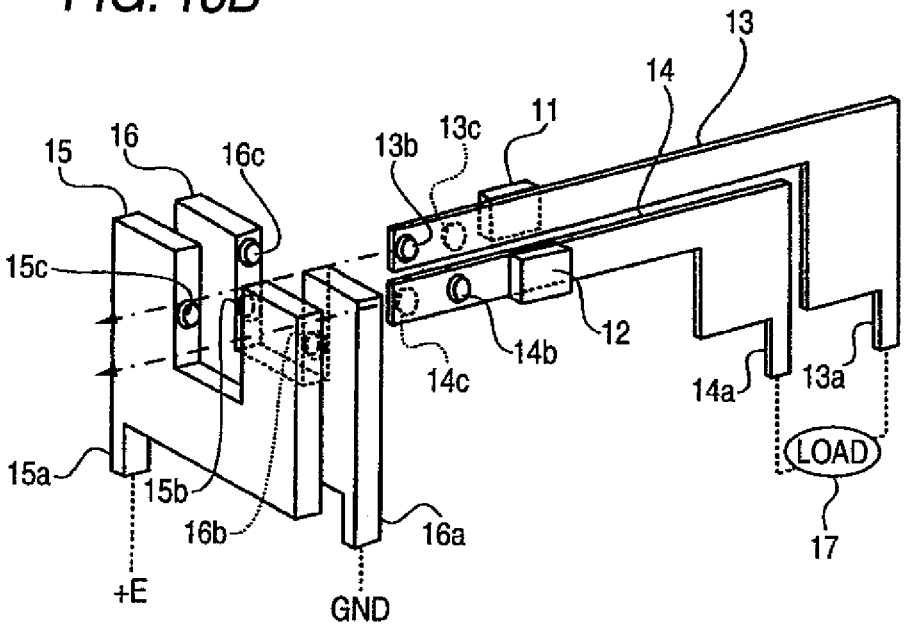
PRIOR ART FIG. 13B

FIG. 11 is a conceptual diagram showing the facing gap F in an actual housing. A position relationship is indicated by absence or presence of a hatching. More specifically, the component part with the hatching is disposed under the component part without the hatching. When the comment parts are perfectly overlapped so that the underlaid component part cannot be seen, a part of the underlaid (hidden) component part is shown in an exploded fashion. In this embodiment, since the second moving contact spring 41 is disposed under the first moving contact spring 32, the contacts 41*a* and 41*b* of the second moving contact spring 41 are disposed under the contacts 32*a* and 32*b* of the first moving contact spring 32.

Also, the wall 23*a* of the B-fixed terminal unit 23 is disposed under the wall 22*b* of the A-fixed terminal unit 22, and the wall 22*a* of the A-fixed terminal unit 22 is disposed under the wall 23*b* of the B-fixed terminal unit 23. Further, the contact 23*d* of the B-fixed terminal unit 23 is disposed under the contact 22*f* of the A-fixed terminal unit 22, and the contact 22*d* of the A-fixed terminal unit 22 is disposed under the contact 23*f* of the B-fixed terminal unit 23.

As described in the foregoing, the following effects are achieved according to the electromagnetic relay 20 of this embodiment.

(1) Since the A-fixed terminal unit 22 and the B-fixed terminal unit 23 are housed together with the first and the second moving contact springs 32 and 41 and the first and the second return springs 33 and 42 in the facing gap F of the two electromagnet units (the first electromagnet unit 24 and the second electromagnet unit 25), it is possible to reduce the length D of the base 21 as compared to the conventional technology. More specifically, though the length (La) of the base 6 is larger in the conventional technology than this embodiment due to the length Ld required for the fixed contact terminal plates 15, 16, at least the length Ld of the conventional technology is eliminated from the length D of the base 21 of this embodiment since the length D of the base 21 is a total of a length of the first electromagnet unit 24, a thickness of the first iron piece 31, and a thickness of the first moving contact spring 32 (or a total of a length of the second electromagnet unit 25, a thickness of the second iron piece 40 and a thickness of the second moving contact spring 41). Thus, it is possible to resolve the problem of the large base size of the conventional technology.

(2) Because the C-terminal 35 is electrically connected to the first moving contact spring 32 via the first yoke 29 and the first return spring 33, and because the C-terminal 44 is electrically connected to the second moving contact spring 41 via the second yoke 38 and the second return spring 42, it is unnecessary to use the L-shaped moving contact springs 13 and 14 and the terminals 13*a* and 14*a* of the conventional technology. Thus, only the general function and characteristics of an ordinary contact spring are required for each of the first and the second moving contact springs 32 and 41, so that the first and the second moving contact springs 32 and 41 have an identical shape (length, width, thickness), thereby resolving the problem of difference in spring constant of the conventional technology.

What is claimed is:

1. An electromagnetic relays comprising:

a first electromagnet unit and a second electromagnet unit disposed in parallel on a base in such a fashion that axial directions thereof are oriented to an identical direction and a predetermined facing gap is defined therebetween, a first moving contact spring and a second moving contact spring disposed in such a fashion as to be overlaid along a vertical direction on the base;

an A-fixed terminal unit and a B-fixed terminal unit provided with a plurality of contacts with which contacts of the first and the second moving contact springs selectively contact depending on a state of excitation/non-excitation of the first and the second electromagnet units; and a pair of C-terminals, wherein the first moving contact spring, the second moving contact spring, the A-fixed terminal unit, and the B-fixed terminal unit are housed in the facing gap, the second moving contact spring is disposed under the first moving contact spring, the first moving contact spring and the second moving contact spring having a same spring constant, at least one of component parts of the first electromagnet unit is disposed on an electric connection passage between the first moving contact spring and one of the C-terminals, at least one of component parts of the second electromagnet unit is disposed on an electric connection passage between the second moving contact spring and the other one of the C-terminals, and the first moving contact, the second moving contact, the A-fixed terminal unit. and the B-fixed terminal unit are positioned between the first and second electromagnet units.

* * * * *